US011415025B2

(12) United States Patent
Sombounkhanh et al.

(10) Patent No.: US 11,415,025 B2
(45) Date of Patent: Aug. 16, 2022

(54) DISTRIBUTOR SECTOR OF A TURBOMACHINE COMPRISING AN ANTI-ROTATION NOTCH WITH A WEAR INSERT

(71) Applicant: SAFRAN AIRCRAFT ENGINES, Paris (FR)

(72) Inventors: Somphone Sombounkhanh, Moissy-Cramayel (FR); Etienne Leon Francois, Moissy-Cramayel (FR); Thomas Pierre-Henri Paul Gardon, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 140 days.

(21) Appl. No.: 16/556,129

(22) Filed: Aug. 29, 2019

(65) Prior Publication Data

US 2020/0072085 A1 Mar. 5, 2020

(30) Foreign Application Priority Data

Aug. 31, 2018 (FR) ..... 1857866

(51) Int. Cl.
*F01D 25/24* (2006.01)

(52) U.S. Cl.
CPC ..... *F01D 25/246* (2013.01); *F05D 2230/64* (2013.01); *F05D 2240/80* (2013.01); *F05D 2260/30* (2013.01)

(58) Field of Classification Search
CPC . F01D 9/04; F01D 9/041; F01D 25/24; F01D 25/243; F01D 25/246; F05D 2230/30; F05D 2230/64; F05D 2230/80; F05D 2240/10; F05D 2240/11; F05D 2240/128;
(Continued)

(56) References Cited

U.S. PATENT DOCUMENTS 2,917,276 A * 12/1959 Klompas ..... F01D 9/042 415/189
4,687,413 A * 8/1987 Prario ..... F01D 11/08 403/319

(Continued)

FOREIGN PATENT DOCUMENTS

| | | |
|---|---|---|
| EP | 3351738 A2 | 7/2018 |
| FR | 2960591 A1 | 12/2011 |
| FR | 3003894 A1 | 10/2014 |

OTHER PUBLICATIONS

Preliminary Research Report and Written Opinion received for French Application No. 1857866, dated May 6, 2019, 9 pages (1 page of French Translation CoverSheet and 8 pages of original document).

*Primary Examiner* — Courtney D Heinle
*Assistant Examiner* — Danielle M. Christensen
(74) *Attorney, Agent, or Firm* — Womble Bond Dickinson (US) LLP

(57) ABSTRACT

A distributor sector of a turbine of a turbomachine, including an outer platform including a downstream cylindrical hook adapted to engage with the turbomachine casing, the hook including a part in which is formed a U-shaped anti-rotation notch including a bottom and two lateral walls extending from the bottom, the notch being at least partially covered by a wear insert inserted in the notch, the insert being removeable.

8 Claims, 8 Drawing Sheets

(58) Field of Classification Search
CPC ..... F05D 2240/14; F05D 2240/80; F05D 2260/30; F05D 2260/31; F05D 2260/39
See application file for complete search history.

(56) References Cited

U.S. PATENT DOCUMENTS

| | | | | |
|---|---|---|---|---|
| 7,334,983 | B2 * | 2/2008 | Alvanos | F01D 11/02 415/115 |
| 9,062,553 | B2 * | 6/2015 | Baumas | F01D 9/042 |
| 9,650,905 | B2 * | 5/2017 | Earl | F01D 25/246 |
| 2010/0068050 | A1 * | 3/2010 | Hansen | F01D 25/246 415/209.3 |
| 2014/0234098 | A1 | 8/2014 | Anderson et al. | |

* cited by examiner

DISTRIBUTOR SECTOR OF A TURBOMACHINE COMPRISING AN ANTI-ROTATION NOTCH WITH A WEAR INSERT

GENERAL TECHNICAL FIELD

The invention relates to the general field of turbomachines and more particularly turbomachine elements comprising anti-rotation notches in particular those of low-pressure turbine distributor sectors and more particularly those of fastening structures of such sectors.

STATE OF THE ART

A turbomachine comprising one or several air compression sections admitted in the engine (generally a low-pressure section and a high-pressure section).

Typically, a low-pressure turbine includes several successive expansion stages. Each of these stages exhibits a mobile wheel (rotor) and a stationary wheel (also called distributor or stator).

FIGS. 1 and 2 illustrate a low-pressure turbine oriented longitudinally from upstream to downstream according a direction F.

In a known manner, a low-pressure turbine comprises mobile wheels 10 and distributors 11. Each distributor 11 is divided into sectors, that is to say, formed of several radial sectors 12, each bearing a plurality of stationary blades 20. The radial sectors 12 are each fastened on a casing 13 at their farthest end from the central axis by an outer annular platform 14. The outer platform 14 exhibits from upstream to downstream, upstream cylindrical hooks 16 and downstream cylindrical hooks 15 making it possible to fasten the platform 14 onto the casing 13.

The upstream and downstream are defined here by the flow direction of the gases in the turbine (arrow F on FIGS. 1 and 2).

Due to the axial symmetry of the distributors and the tangential forces resulting from the gaseous flow that crosses them, it is necessary to provide means for locking the sectors in rotation. For that, the downstream hook 15 of the outer platform is shaped so as to create anti-rotation notches in which anti-rotation pins are inserted. These pins take the form of a head placed in these notches, thus, preventing any movement of rotation of the distributor segment around its axis X.

FIG. 3 illustrates a sector 12 whereof the downstream hook 16 comprises a U-shaped anti-rotation notch 17.

A problem with this notch 17 is that it is subject to wear by pressure of bearing stress and friction.

This wear implies that

- the low-pressure distributor is not sufficiently maintained and can move about inside the casing;
- the tangential and axial positions of the distributors are no longer compliant, thus, damaging the clearances in the turbine with risks of friction with the mobile wheels and deteriorating turbine performance.

Such wear typically requires a repairing operation by welding, which causes problems of cracks around and in the repaired area, due to the significant heat gradient during the placing of the metal welding.

PRESENTATION OF THE INVENTION

The invention proposes to overcome at least one of these drawbacks.

To this end, the invention proposes a distributor sector of a turbine of a turbomachine, comprising an outer platform comprising a downstream cylindrical hook adapted to engage with the turbomachine casing, the hook comprising a part in which is formed a U-shaped anti-rotation notch comprising a bottom and two lateral walls extending from said bottom, said notch being at least partially covered by a wear insert inserted in said notch, the insert being removeable.

The invention is advantageously completed by the following characteristics, taken alone or in any technically feasible combination possible:

- the wear insert has a U shape and is of complementary shape with the notch, said insert being inserted according to an axial direction facing the bottom of the notch, the insert comprising an inner base in contact with the bottom of the notch and two lateral walls extending perpendicularly from the base of the insert, the lateral walls of the insert being in contact with the lateral walls of the notch;
- the base of the insert is clipped to the bottom of the notch the insert comprising an upper lip and a lower lip, said lips extending according to an axial direction from the base of the insert such as to encircle the base of the notch;
- each lateral wall of the insert comprises an upper lip and a lower lip, said lips extending tangentially from each wall such as to encircle each lateral wall of the notch;
- the insert is positioned iso-statically on the notch:
- at least the upper lip forming a flat support for the insert according to a radial direction,
- the inner base forming a lineic contact for the insert according to an axial direction;
- the lateral wall forming an abutment for the insert according to a tangential direction.
- the insert is a U shape inserted in the notch according to a radial direction, the insert further comprising two wings extending from each lateral wall of the U shape according to a direction perpendicular to the radial direction, said wings resting on the outer annular surface of the upper annular platform of the hook;
- the insert is positioned iso-statically on the notch:
- the wings in contact with the annular surface forming a flat support for the insert according to a radial direction;
- one of the lateral walls forming a lineic contact for the insert according to an axial direction;
- an end of one of the wings forming an abutment for the insert according to a tangential direction.
- the L shaped insert inserted into the notch according to a tangential direction in flat support with an inner annular surface of the outer platform of the hook;
- the insert is iso-statically positioned on the notch:
- a contact between the inner annular surface forming a flat support for the insert in the radial direction
- one of the lateral walls of the notch forming a lineic contact for the insert in the tangential direction;
- the bottom of the notch forming an abutment for the insert in the axial direction.
- the insert is a U shape inserted in the notch according to a tangential direction perpendicular to an axial direction facing the bottom of the notch, the insert comprising an inner base in contact with a lateral wall of said notch, two lateral walls extending from said inner base.
- the insert is positioned iso-statically on the notch:
- one of the lateral walls forming a flat support for the insert in the radial direction;

one of the lateral walls of the notch forming a lineic contact for the insert in the tangential direction;

the bottom of the notch forming an abutment for the insert in the axial direction.

the insert is of a Cobalt based metal alloy material, for example of type HA188, MAR-M-509, HS25.

the insert is formed in a piece of sheet metal of a thickness ranging between 0.08 mm and 4 mm.

it comprises an upper annular platform comprising the part.

The invention also relates to a low-pressure turbine of a turbomachine comprising a distributor section according to the invention.

The invention has many advantages.

The insert is removeable so that, once worn, it can easily be changed, thus, greatly simplifying the reparation of low-pressure turbines.

The insert efficiently protects the walls of the anti-rotation notch.

PRESENTATION OF THE FIGURES

Other characteristics, aims and advantages of the invention will become apparent in the following description, which is purely illustrative, and non-limiting, and which should be read in light of the accompanying figures on which, apart from FIGS. 1 to 3 already mentioned:

On the set of figures, similar elements bear identical references.

DETAILED DESCRIPTION OF THE INVENTION

Figure 1:
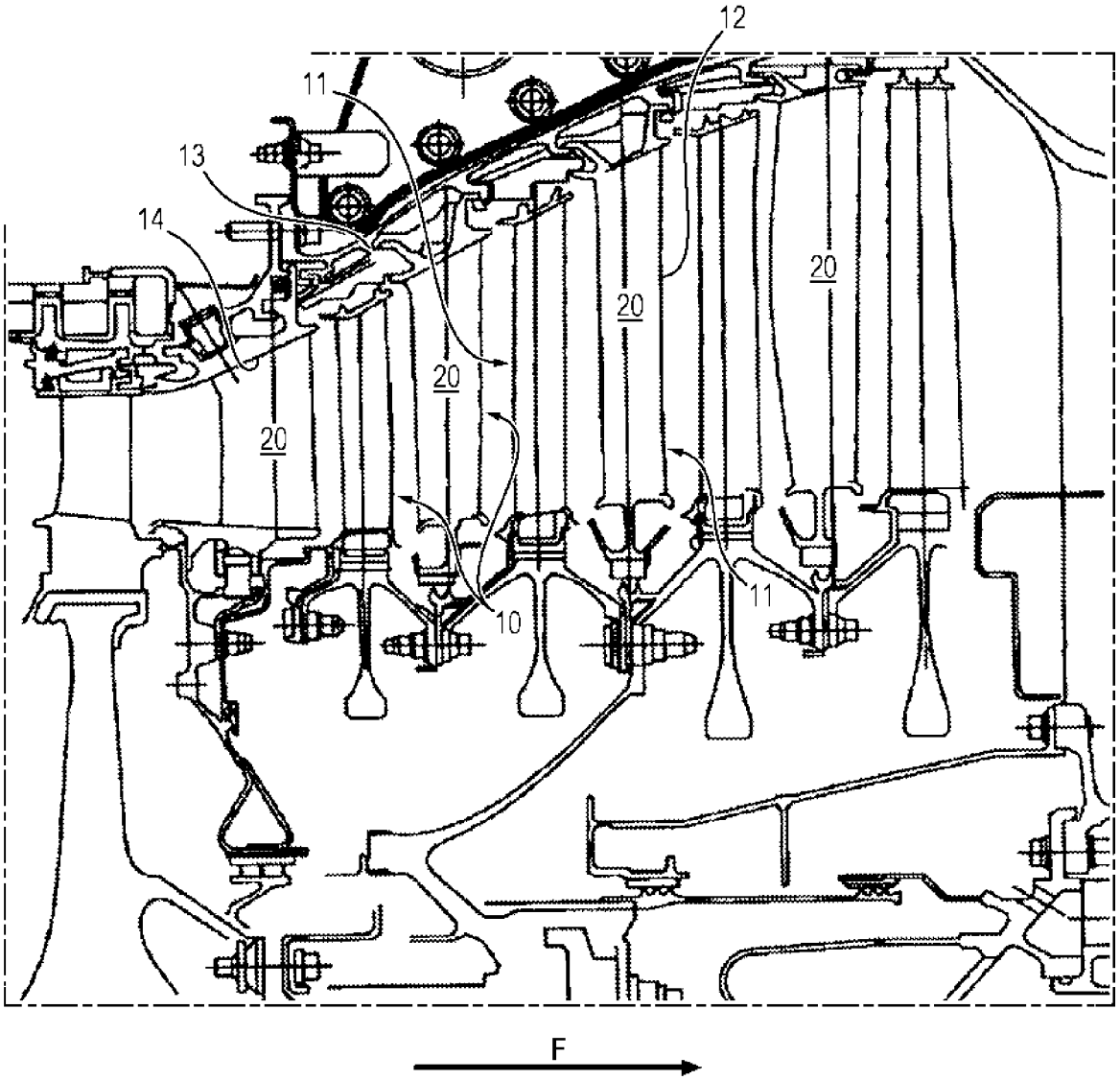
Figure 2:
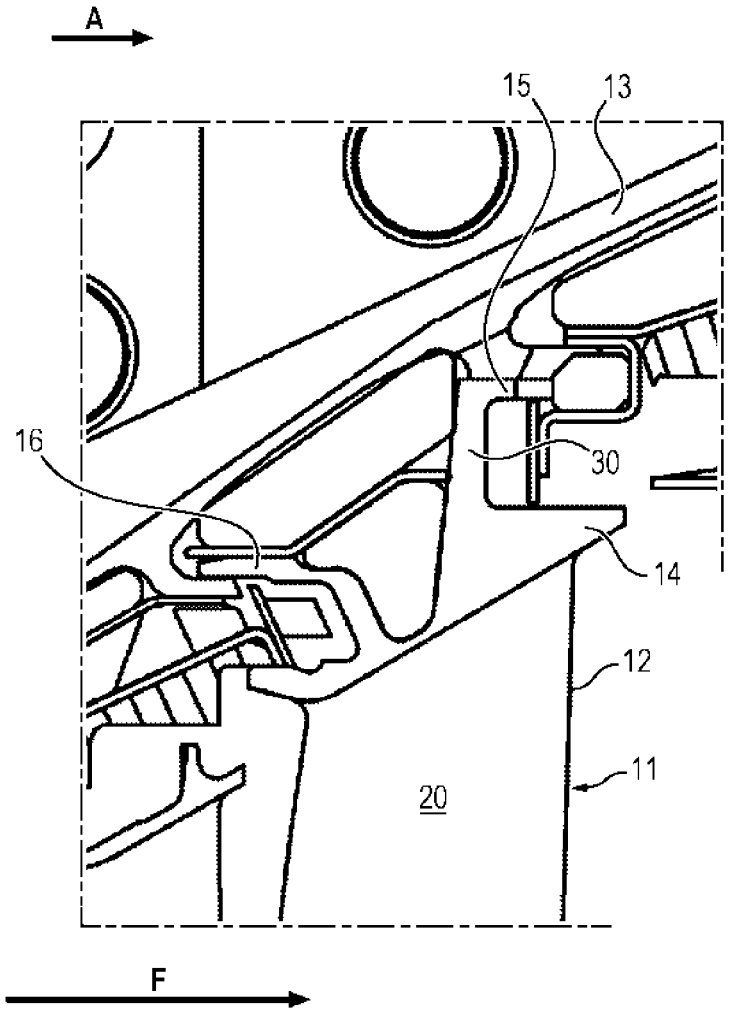

In the following, upstream and the downstream are defined with respect to the normal direction of flow of the fluid (arrow F on FIGS. 1 and 2). The turbine has a symmetry of revolution around an axis parallel to a direction of flow of the fluid. An axial direction corresponds to a direction of flow of the fluid, and a radial direction is a direction perpendicular to this axis and passing by it. Unless otherwise specified, inner and outer, shall be used respectively, with reference to a radial direction such that the inner part or face (i.e., radially internal) of an element is nearest to the axis of symmetry of the turbine than the outer part or face (i.e., radially external) of the same element.

Figure 3:
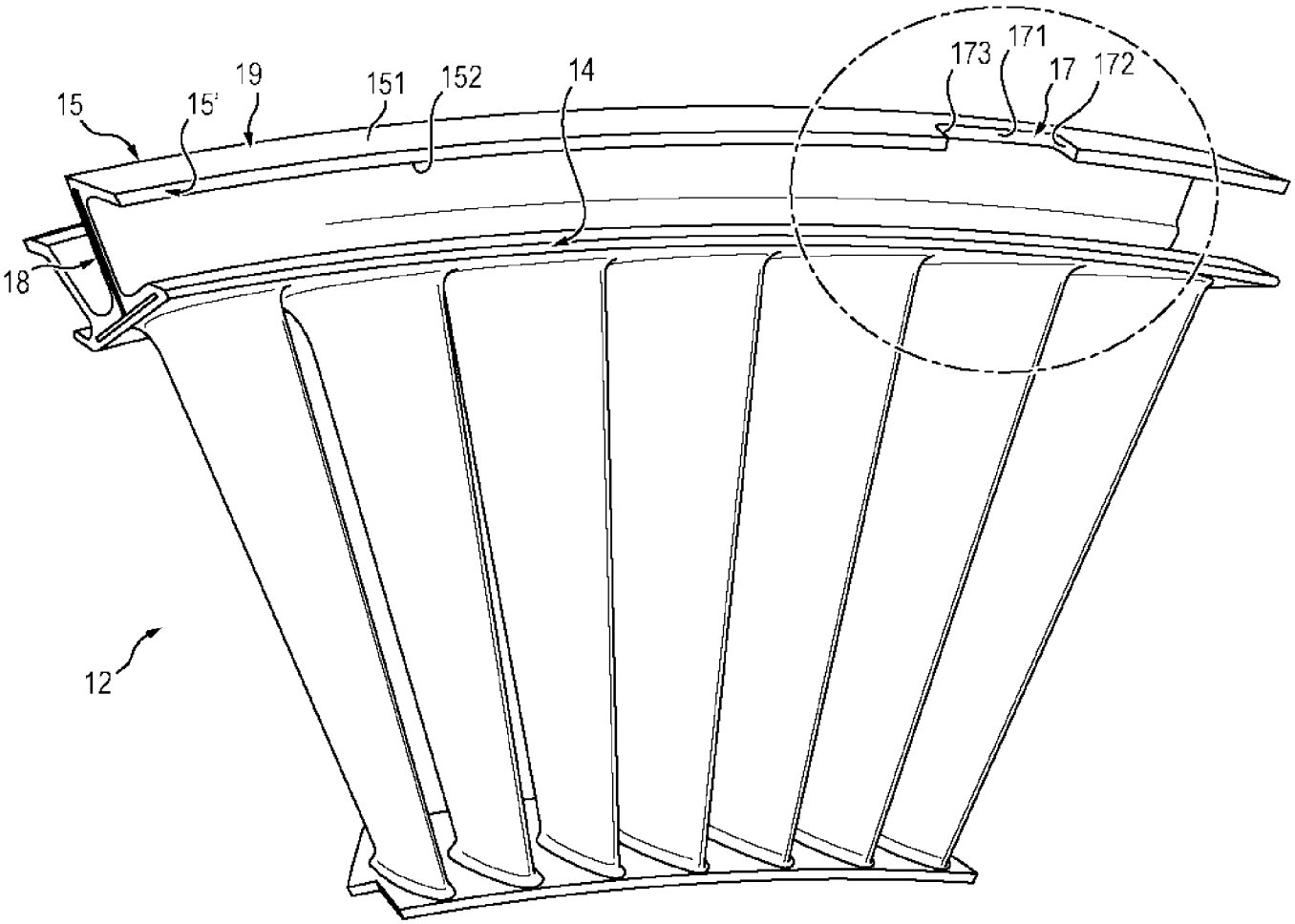

Returning to FIGS. 2 and 3, the downstream hook 15 is constituted of the outer platform 14 and an upper annular platform 15' whereof a part 19 extends in a cornice from a radial part 18 itself extending from the outer platform 14. The outer platform 14 and the upper annular platform 15' form an empty space wherein the casing 13 is inserted.

The upper annular platform 15' comprises a U-shaped anti-rotation notch 17 forming an opening in the part 19 in a cornice.

In a non-limiting manner, the notch has a U shape and such that the base of the U is facing an axis extending in a direction opposite to the direction of flow of the fluid in the turbine.

The notch 17 is hence formed in an annular plate 15' constituting the turbine and comprises a bottom 171 from which extend lateral walls 171, 172 in a U shape. Furthermore, the annular plate 15' comprises an upper annular surface 151 and a lower annular surface 152.

As it will be described more precisely in relation with FIGS. 4 to 8, in order to prevent wear at the anti-rotation notch, the hook or more generally any element of a turbomachine comprising an anti-rotation notch that can comprise a wear insert 50*a*, 50*b*, 50*c*, 50*d*, 50*e* which partially or entirely covers the anti-rotation notch 17.

Such an insert is removeable and thereby, easily interchangeable.

The insert 50*a*, 50*b*, 50*c*, 50*d*, 50*e*, is preferably in a material different from that within the notch wherein it is inserted. It shall be ensured that the material of the insert is compatible with the material of the notch.

The insert is preferably in a Cobalt-based metal alloy material, for example of type HA188, MAR-M-509, HS25. Such a material is advantageous in that it resists well to friction with respect to the material of the distributor which is generally a Nickel-based metal alloy of type R77, IN100.

In an advantageous manner, the insert is in sheet metal (foil) of a thickness of 0.08 to 0.4 mm, typically 0.25 mm.

In the following, are described several embodiments that implement the wear insert in the notch in relation to FIGS. 4 to 8 whereon axes A, T and R are represented corresponding respectively to axes according to axial, tangential and radial directions.

Figure 4:
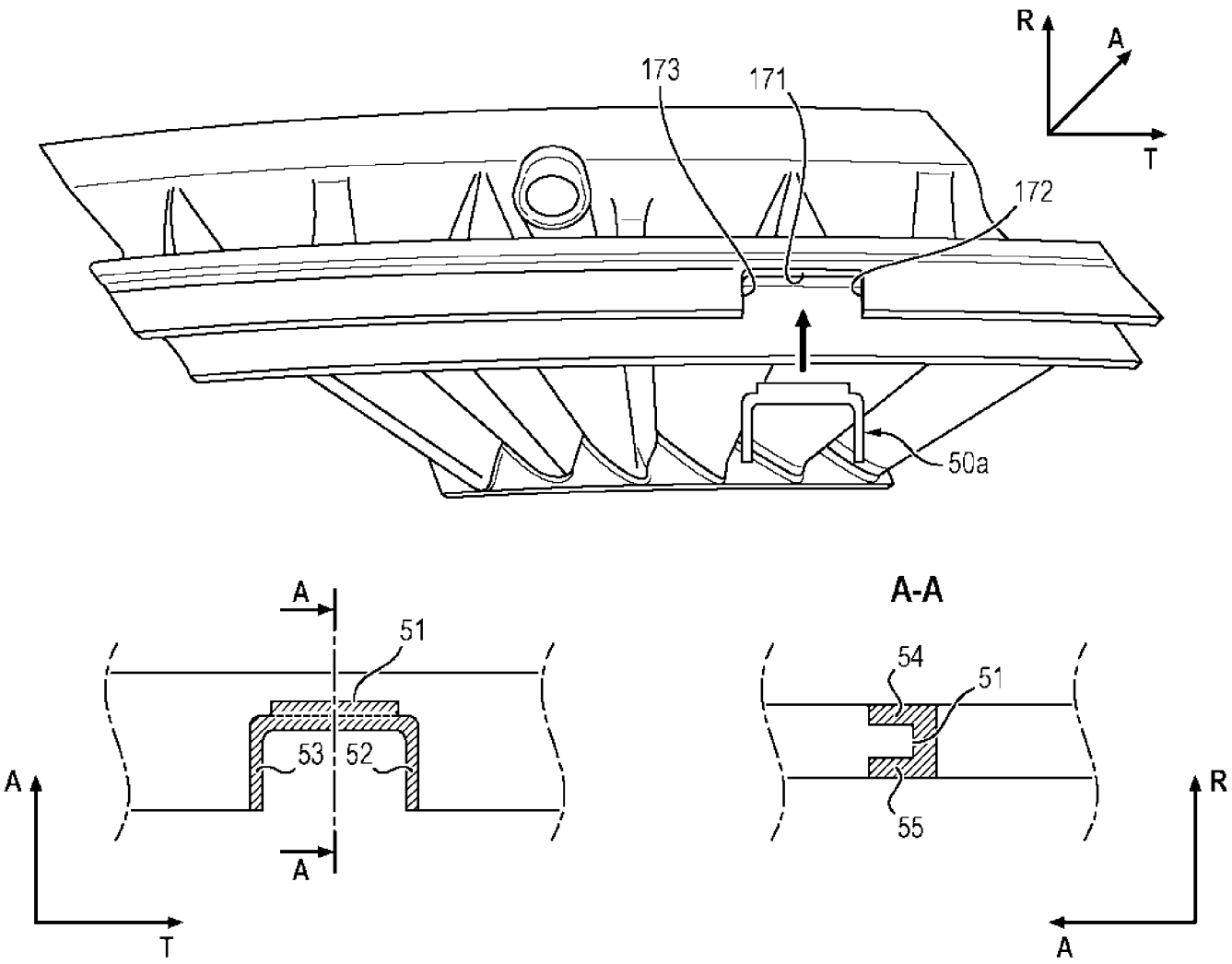
FIG. 4 illustrates an anti-rotation notch comprising a wear insert according to a first embodiment.

According to a first embodiment illustrated on FIG. 4, the wear insert 50*a* is a U shape and is complementary with the notch 17. It is inserted according to an axial direction facing the bottom 171 of the notch. Such an insert comprises an inner base 51 in contact with the bottom 171 of the notch and two lateral walls 52, 53 that extend perpendicularly from the inner base 51 of the insert, the lateral walls 52, 53 of the insert being in contact with the lateral walls 172, 173 of the notch.

According to this first embodiment, the inner base 51 of the insert is clipped to the bottom of the notch 17 and is in abutment with the bottom 171 of the notch 17, the insert 50*a* comprising an upper lip 54 and a lower lip 53, these lips 53, 54 extend according to an axial direction from the inner base 51 of the insert in such a manner as to encircle the base 171 of the notch 17.

Thus, according to this first embodiment, the insert 50*a* is positioned iso-statically on the notch 17, for example:

Radial direction acting as flat support ensured by the upper lip 54 of the insert;

Axial direction acting as lineic contact is ensured by the inner base 51;

Tangential direction acting as abutment is ensured by one of the lateral walls 52.

The insert 50*a* according to this first embodiment is maintained in the notch, either by tight mounting at the lateral walls 52, 53 of the insert 50*a* or adjusted to the notch or by means of welding point at these same walls.

Figure 5:
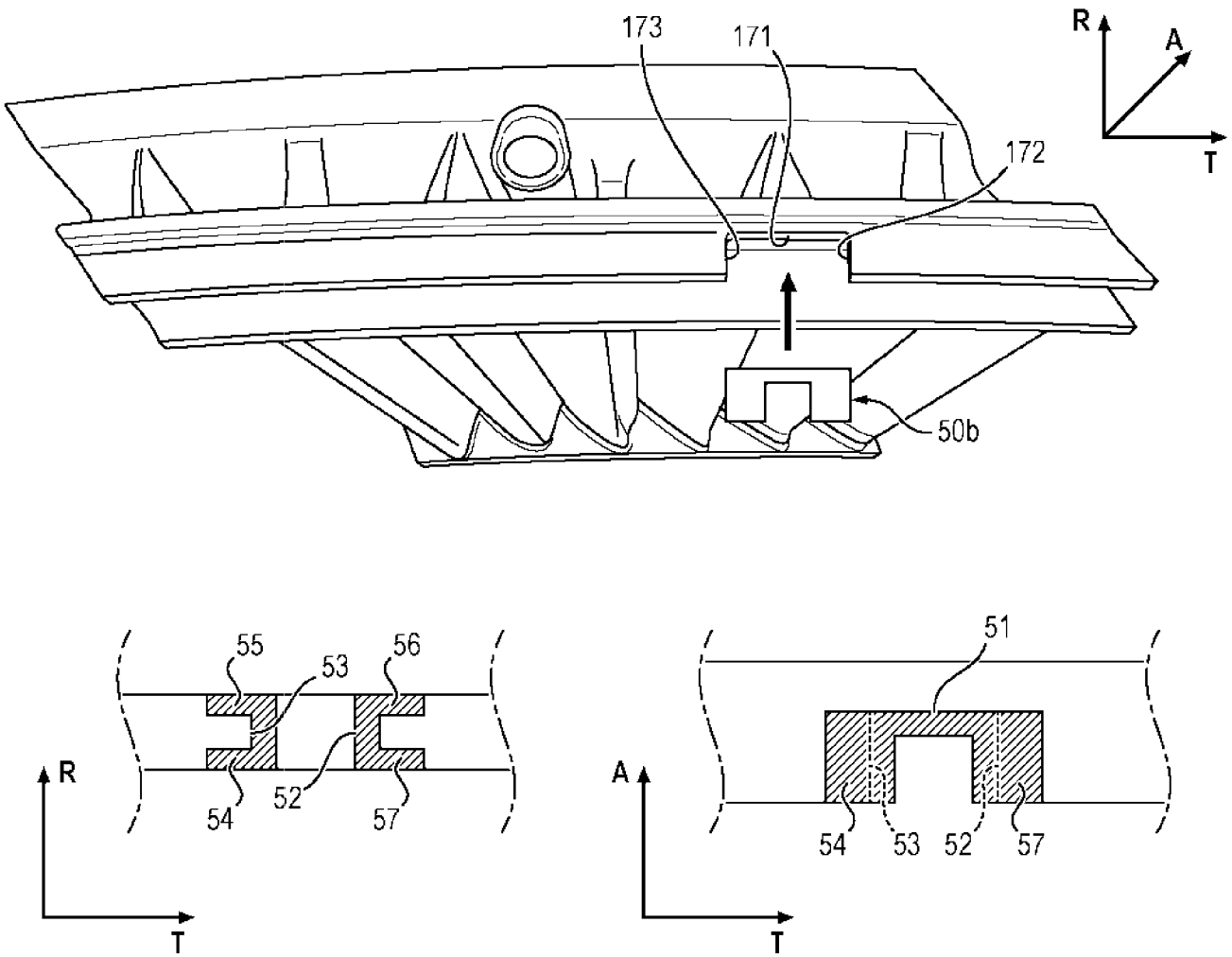
FIG. 5 illustrates an anti-rotation notch comprising a wear insert according to a second embodiment.

According to a second embodiment, illustrated on FIG. 5, the wear insert 50*b* here also has a U shape and has a form that is complementary to the notch. It is inserted according to an axial direction facing the bottom of the notch. Such an insert comprises an inner base 51 in contact with the bottom 171 of the notch and two lateral walls 52, 53 that extend perpendicularly from the inner base 51 of the insert, the lateral walls 52, 53 of the insert being in contact with the lateral walls 172, 173 of the notch.

According to this second embodiment, the lateral walls 52, 53 are clipped to the lateral walls 172, 173 of the notch 17 by means of upper and lower lips 54, 55, 56, 57 that extend respectively from each lateral wall 52, 53 in such a manner as to encircle each lateral wall of the notch. Thus, the lips respectively embrace the lateral walls of the notch and are supported by the inner and outer walls of the piece in which the notch 17 is formed.

Thus, according to this second embodiment, the insert 50*b* is positioned iso-statically in the notch 17, for example:

Radial direction acting as flat support is ensured by the upper lips 55, 56 of the insert Axial direction acting as lineic contact is ensured by the inner base 51.

Tangential direction acting as abutment is ensured by one of the lateral walls 52.

The insert 50*b* according to this second embodiment is maintained in the notch either by tight mounting at the upper and lower lips 54, 55, 56, 57 extending from the lateral walls 52, 53 of the insert 50*a* or adapted to the notch or by means of welding point.

Figure 6:
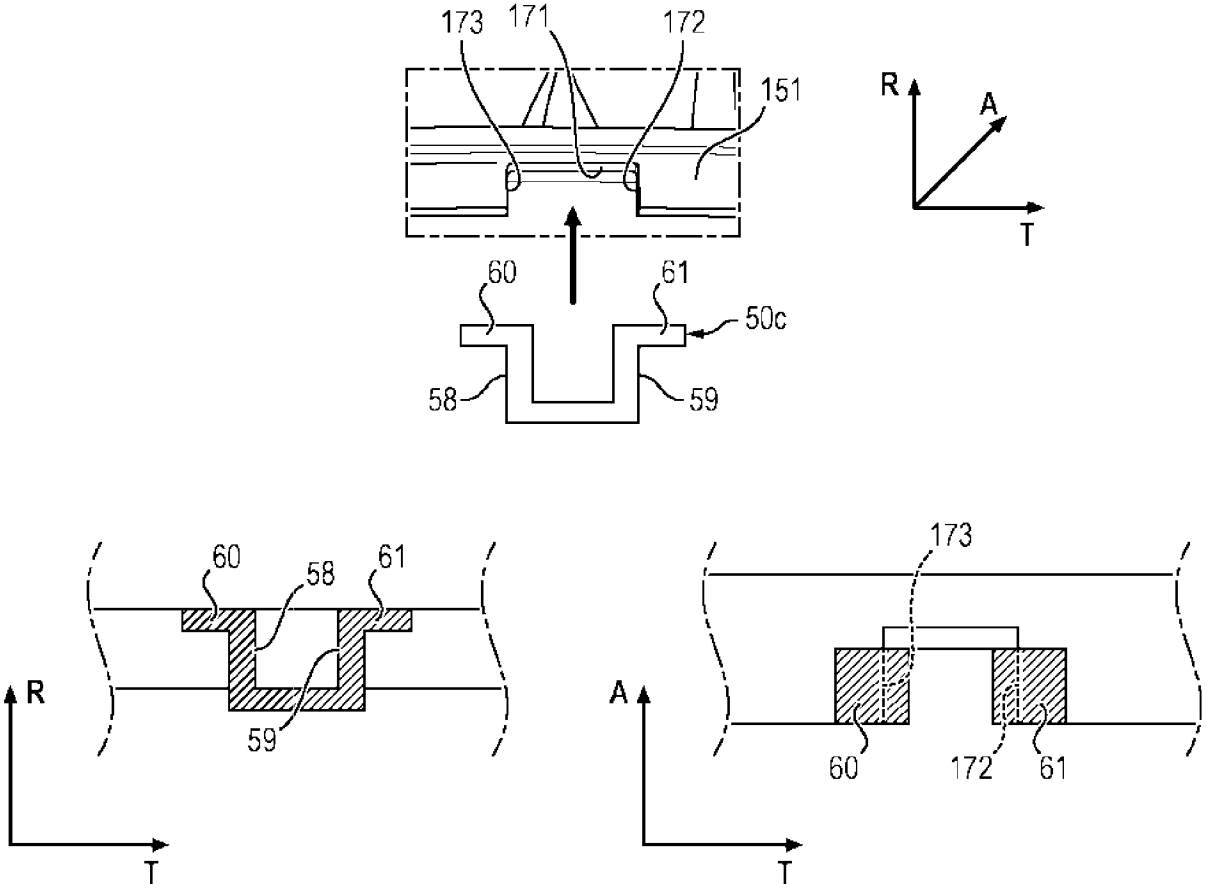
FIG. 6 illustrates an anti-rotation notch comprising a wear insert according to a third embodiment.

According to a third embodiment, illustrated on FIG. 6, the insert 50*c* is a general U shape inserted in the notch 17 according to a radial direction, the insert further comprising two wings 60, 61 extending from each lateral wall 58, 59 of the U shape according to a direction perpendicular to the radial direction, the wings resting on the outer annular surface 151 of the piece in which the notch 17 is formed.

Thus, according to this third embodiment, the insert 50*c* is positioned iso-statically on the notch 17, for example:

Radial direction acting as flat support is ensured by the wings 60, 61 in contact with the outer annular surface 151;

Axial direction acting as lineic contact is ensured by the lateral wall 59;

Tangential direction acting as abutment is ensured by a welding point performed at the end of one of the wings of the insert 50*c*.

The insert 50*c* according to this third embodiment is maintained in the notch by means of welding points carried out at one end of the wings of the insert 50*c*. The welding point shall preferably be carried out on one of the two wings positioned on the part of the notch subjected to wear.

Figure 7:
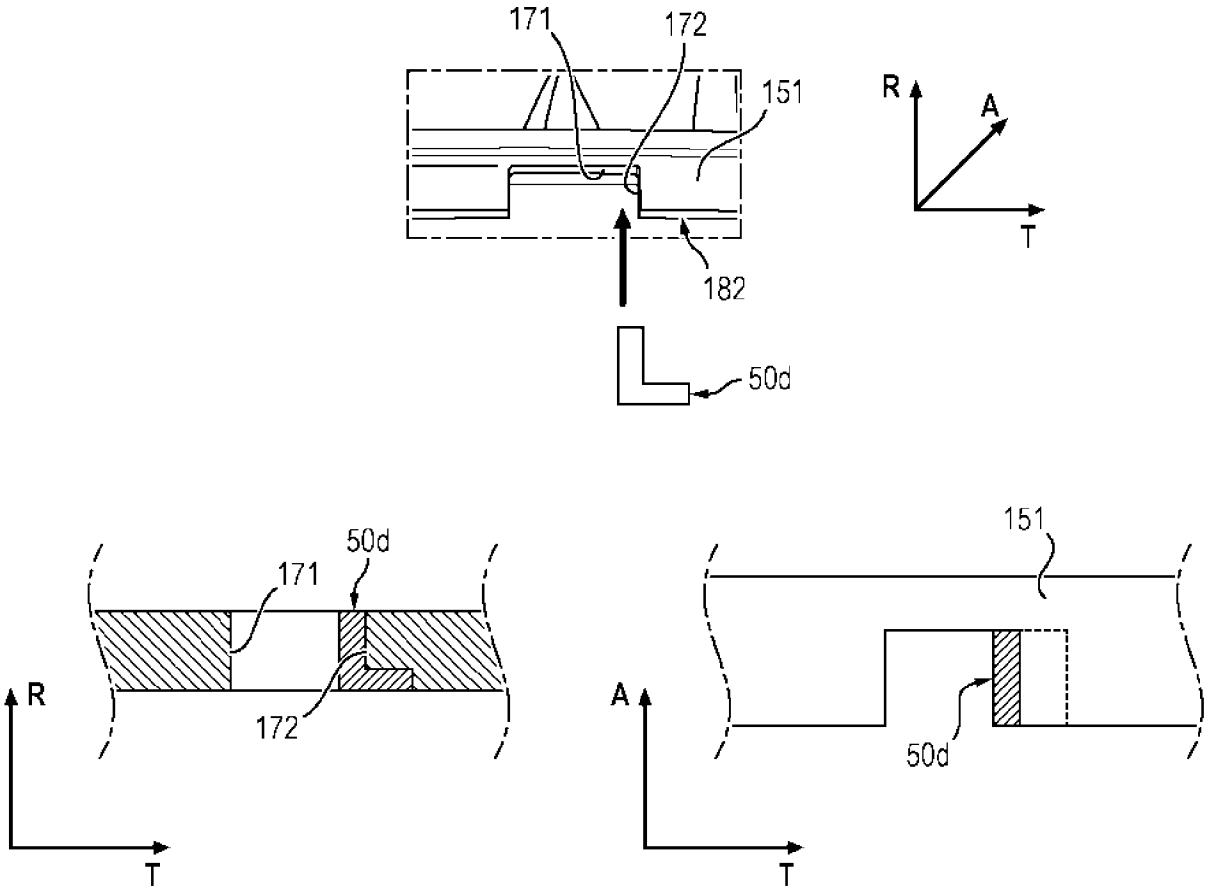
FIG. 7 illustrates an anti-rotation notch comprising a wear insert according to a fourth embodiment.

According to a fourth embodiment illustrated on FIG. 7, the insert 50*d* has an L shape and is inserted in the notch in flat support with an inner annular surface of the outer platform 18 of the hook 16. The L-shaped insert is inserted in the bottom 171 of the notch according to a tangential direction.

According to this fourth embodiment, the insert 50*d* is positioned iso-statically in the notch 17, for example:

Radial direction acting as flat support, is ensured by the contact with the lower annular surface of the piece in which the notch is formed;

Tangential direction acting as lineic contact is ensured by one of the lateral walls of the notch subject to wear;

Axial direction acting as abutment is ensured by the contact with the bottom of the notch 171.

The insert 50*d* according to this fourth embodiment is maintained in the notch by means of welding points carried out at the inner annular surface of the piece in which the notch 17 is formed.

Figure 8:
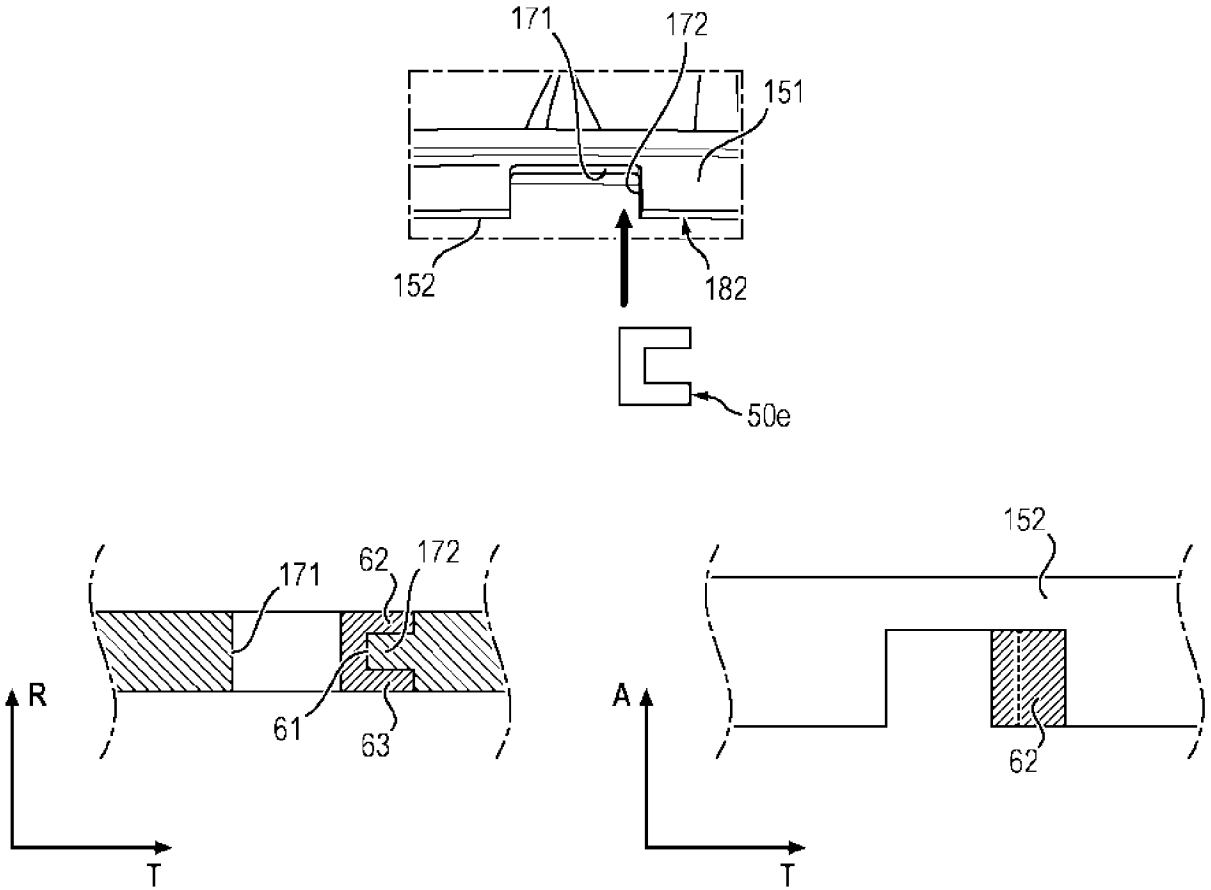
FIG. 8 illustrates an anti-rotation notch comprising a wear insert according to a fifth embodiment.

According to a fifth embodiment illustrated on FIG. 8, the insert 50*e* is U shaped and inserted in the notch according to a tangential direction facing a lateral wall of the notch that is subject to wear.

The U-shaped insert comprises an inner base 61 in contact with one of the lateral walls of the notch 17 and two lateral walls 62, 63 extending from the inner base 61.

According to this fifth embodiment, the inner base 61 of the insert is clipped at the lateral walls of the notch 17 and is in abutment with one of the lateral walls of the notch 17 that is subject to wear, the lateral walls 61, 62 extending from the inner base 61 encircle one of the lateral walls. The lateral walls 62, 63 hence rest on the one hand on the outer annular surface of the piece in which the notch is formed and on the other hand on the inner annular surface of the same piece.

The U-shaped insert is positioned iso-statically on the notch on the wall side subject to wear at the outer platform of the distributor, for example:

Radial direction acting as flat support is ensured by the lateral wall 62.

Tangential direction acting as lineic contact is ensured by the lateral wall 61;

Axial direction acting as abutment is ensured by the contact with the bottom of the notch 171.

The insert 50*e* according to this fifth embodiment is maintained in the notch by means of welding points carried out at the inner annular surface of the piece in which the notch 17 is formed.

The invention claimed is:

1. A distributor sector of a turbine of a turbomachine, comprising an outer platform comprising a downstream cylindrical hook adapted to engage with the turbomachine casing, the hook comprising a part in which is formed a U-shaped anti-rotation notch comprising a bottom and two lateral walls extending from said bottom, said notch being at least partially covered by a wear insert inserted in said notch, the insert being removeable, the wear insert is U-shaped and is of complementary shape with the notch, said insert being inserted according to an axial direction facing the bottom of the notch (17), the insert comprising an inner base in contact with the bottom of the notch and two lateral walls extending perpendicularly from the base of the insert, the lateral walls of the insert being in contact with the lateral walls of the notch, and wherein the insert is positioned iso-statically on the notch:

at least an upper lip of the insert forming a flat support for the insert in a radial direction, the inner base forming along its length a contact for the insert in an axial direction;

each lateral wall forming an abutment for the insert in a tangential direction.

2. The sector according to claim 1, wherein the base of the insert is clipped to the bottom of the notch, the insert comprising the upper lip and a lower lip, said lips extending according to the axial direction from the base of the insert such as to encircle the base of the notch.

3. The sector according to claim 1, wherein each lateral wall of the insert comprises the upper lip and a lower lip, said lips extending tangentially from each wall such as to encircle each lateral wall of the notch.

4. The sector according to claim 1, wherein the insert is of a Cobalt based metal alloy material.

5. The sector according to claim 4, wherein the alloy material is of type of HA188, MAR-M-509, HS25.

6. The sector according to claim 1, wherein the insert is formed in a piece of sheet metal of a thickness ranging between 0.08 mm and 4 mm.

7. The sector according to claim 1, comprising an upper annular platform comprising the part.

8. A low-pressure turbine of a turbomachine comprising a distributor sector according to claim 1.

* * * * *